US010968675B2

(12) United States Patent
Balbo Di Vinadio

(10) Patent No.: US 10,968,675 B2
(45) Date of Patent: Apr. 6, 2021

(54) LIFTING SYSTEM FOR A LIFTABLE SLIDING LEAF

(71) Applicant: SAVIO S.p.A., Chiusa San Michele (IT)

(72) Inventor: Aimone Balbo Di Vinadio, Chiusa San Michele (IT)

(73) Assignee: Savio S.P.A

( * ) Notice: Subject to any disclaimer, the term of this patent is extended or adjusted under 35 U.S.C. 154(b) by 304 days.

(21) Appl. No.: 15/769,819

(22) PCT Filed: Oct. 24, 2016

(86) PCT No.: PCT/IB2016/056376

§ 371 (c)(1),
(2) Date: Apr. 20, 2018

(87) PCT Pub. No.: WO2017/068555

PCT Pub. Date: Apr. 27, 2017

(65) Prior Publication Data

US 2019/0153763 A1 May 23, 2019

(30) Foreign Application Priority Data

Oct. 23, 2015 (IT) ..... 102015000064782
Oct. 23, 2015 (IT) ..... 102015000064931

(51) Int. Cl.
*E05D 15/56* (2006.01)
*E05D 15/06* (2006.01)

(52) U.S. Cl.
CPC ..... *E05D 15/565* (2013.01); *E05D 15/0626* (2013.01); *E05D 2015/0695* (2013.01);
(Continued)

(58) Field of Classification Search
CPC . E06B 3/4636; E05D 15/565; E05D 15/0626; E05D 15/0695; E05F 15/638;
(Continued)

(56) References Cited

U.S. PATENT DOCUMENTS 5,012,611 A * 5/1991 Hsu ..... E06B 7/18 49/225
5,301,468 A * 4/1994 Kamezaki ..... E05D 15/1021 49/225
(Continued)

FOREIGN PATENT DOCUMENTS

DE 1808276 A1 11/1968
DE 20121499 U1 4/2008
(Continued)

OTHER PUBLICATIONS

International Search Report and Written Opinion for PCT/IB2016/056376 dated Feb. 16, 2017.

*Primary Examiner* — Justin B Rephann
(74) *Attorney, Agent, or Firm* — Thomas|Horstemeyer, LLP

(57) ABSTRACT

A lifting system (11) for a liftable sliding leaf (10) comprises a lifting mechanism (16) which can be connected to a top part (12*a*) of the leaf (10), said lifting mechanism (16) being able to move between a first configuration and a second configuration where the leaf may slide or be locked, and a control member (12), which can be located on the fixed frame of the door and can be connected to the lifting mechanism (16) so as to switch it between the two configurations.

7 Claims, 8 Drawing Sheets

(52) U.S. Cl.
CPC ... *E05Y 2201/684* (2013.01); *E05Y 2900/148* (2013.01); *E05Y 2900/15* (2013.01)

(58) Field of Classification Search
CPC ..... E05Y 2900/15; E05Y 2900/148; E05Y 2201/684
See application file for complete search history.

(56) References Cited

U.S. PATENT DOCUMENTS

| | | | | |
|---|---|---|---|---|
| 5,566,505 | A * | 10/1996 | Kamezaki | E05D 15/1021 49/225 |
| 9,458,656 | B2 * | 10/2016 | Mickelson | E05D 15/565 |
| 2002/0053169 | A1 * | 5/2002 | Menuzzo | E05D 15/565 49/360 |
| 2004/0163317 | A1 * | 8/2004 | Reich | E05D 15/565 49/209 |
| 2010/0307064 | A1 * | 12/2010 | Lambertini | E05D 15/565 49/427 |
| 2011/0078956 | A1 * | 4/2011 | Lambertini | E05D 15/565 49/221 |

FOREIGN PATENT DOCUMENTS

| | | | |
|---|---|---|---|
| DE | 102013218948 | A1 | 3/2015 |
| EP | 1908908 | A2 | 4/2008 |
| EP | 2781678 | A2 | 9/2014 |
| FR | 2384933 | A1 | 10/1978 |

* cited by examiner

LIFTING SYSTEM FOR A LIFTABLE SLIDING LEAF

CROSS-REFERENCE TO RELATED APPLICATION

This application is the 35 U.S.C. § 371 national stage application of PCT Application No. PCT/IB2016/056376, filed Oct. 24, 2016, where the PCT claims priority to and the benefit of Italian Patent Application No. 102015000064931, filed on Oct. 23, 2015, and Italian Patent Application No. 102018000064782, filed on Oct. 23, 2015, all of which are herein incorporated by reference in their entireties.

TECHNICAL SECTOR

The present invention is classifiable, in general terms, within the sector of doors and windows and fixtures; in particular, the invention relates to a lifting system for a sliding leaf.

PRIOR ART

It is known to use sliding doors or windows for applications in particular in the civil construction sector.

Such doors or windows, in particular those mounted in the external perimetral walls of a dwelling, comprise sliding leaves which, when in the closed position, rest on the ground. In order to activate sliding of the leaf, the leaf must be lifted from the ground and positioned on suitable guides which allow lateral sliding thereof.

The conventional solution of positioning the sliding guides on the ground has many drawbacks, for example the risk of tripping on the raised profile of the guide, or the need for frequent maintenance and careful cleaning to remove the dirt which collects inside the groove.

To solve these and other problems, the solution of mounting the sliding guides on the top part of the door or window has been considered in the prior art. In this case, however, the leaf cannot be rested on the ground and it therefore remains always in a suspended position. Consequently, the sliding leaf cannot be easily fixed in position during its lateral sliding movement.

Therefore, although the solution of mounting the guide of the sliding leaf on the top part of the counterframe is able to achieve advantages in terms of simpler assembly of the structure and optionally drainage of the water from the exterior (which does not collect in the bottom track), a structure thus designed is subject to the problem that there are no suitable solutions for fixing it in position.

In this way, such a configuration negatively affects the safety and usability of the sliding door, also in terms of its reliability and its resistance to break-in.

Moreover, the possibility for the leaf to rest on the ground would cause compression of the seals, increasing the performance thereof in terms of water-tightness and sealing action against the external air; however, a guide which slides along the top according to the prior art is unable to benefit from this insulating effect.

In addition, the fact that the leaf remains continuously suspended increases the stresses acting on the top guides, negatively affecting the working life of the manufactured product; on the other hand, if the leaf were able to rest on the ground, its weight would be transmitted to the ground, without stressing the guiding parts.

A partial solution to the above drawbacks, according to the prior art, is described in DE 1808276, which describes a system in which the leaf lifting system is mounted on the fixed frame and is connected to a bottom guide on which the leaf slides. In this case, the operating mechanism lifts the leaf by means of operation of a control member, allowing the leaf to travel on roller wheels movable along rails located on the ground. However, such a configuration involves a series of drawbacks, first and foremost the fact that the bottom guide, projecting upwards, may result in tripping of the user or may become filled with dirt or also may hinder correct compression of the seals (since the leaf would initially bear against the raised parts of the rails), limiting the capacity for insulation against the air and rain.

SUMMARY OF THE INVENTION

One object of the present invention is to overcome the aforementioned problems.

In order to obtain such a result an opening (in particular, a door or window) is provided, said opening comprising a liftable sliding leaf provided with a lifting mechanism which is able to release the leaf when it is in a closed position, by operating a top part of the leaf.

The liftable sliding leaf will be suspended from a guide to which it is connected along a top edge. Since the leaf may slide laterally (namely, along horizontal guides) it must be released from the closed position by performing a lifting movement, by means of the lifting mechanism which, in the present invention, can be operated by means of a control member or locking/release system which operates a lifting linkage.

In the case in question, the locking and release system, conveniently controlled by a handle, causes pulling of the linkage which, lifting and lowering a tie-rod connected to the top guide by means of a lever system, allows the leaf to be lifted, so that it may be released and slide laterally.

Unlike the conventional systems, the linkage is located, along with the operating mechanism, on the fixed frame of the door and is therefore independent of the leaf which slides on the top guide.

Depending on the type of guide, as will be understood more clearly in the continuation of the description, the lifting system may also be provided with an adjustment mechanism which, in the case where the guide is of the magnetic type, allows the amount by which the leaf is lifted to be predefined, so as to adapt the intensity of the magnetic interaction to the real weight and size of the leaf, which are variable depending on the particular case.

According to one example, this adjustment mechanism comprises a pair of toothed components which mesh together in order to set the maximum and minimum travel of the tie-rod (and, in an associated manner, the top guide).

The advantage is therefore obtained of providing a system of liftable sliding leaves which are able to rest on the ground so as to increase the performance levels of the manufactured product (in terms of sealing action, working life, locking capacity, etc.), with a fixture in which the sliding guide is located on the top edge of the said leaf.

The aforementioned and other objects and advantages are achieved, according to an aspect of the invention, by a lifting system for a liftable sliding leaf, a liftable sliding leaf associated with this lifting system, and a door or window comprising such a liftable sliding leaf, having the characteristic features defined in the attached claims. Preferred embodiments of the invention are defined in the dependent claims.

BRIEF DESCRIPTION OF THE DRAWINGS

The functional and structural characteristics of some preferred embodiments of a lifting system for a liftable sliding leaf, a liftable sliding leaf associated with this lifting system, and a door or window comprising this liftable sliding leaf, according to the invention, will now be described. Reference is made to the attached drawings in which.

DETAILED DESCRIPTION

Before explaining in detail a plurality of embodiments of the invention, it should be made clear that the invention is not limited, in terms of its application, to the constructional de-tails and the configuration of the components described in the description below or illustrated the drawings. The invention may assume other embodiments and be implemented or realized in practice in different ways. It should also be understood that the phraseology and terminology have a descriptive function and should not be regarded as being limiting.

Figure 1:
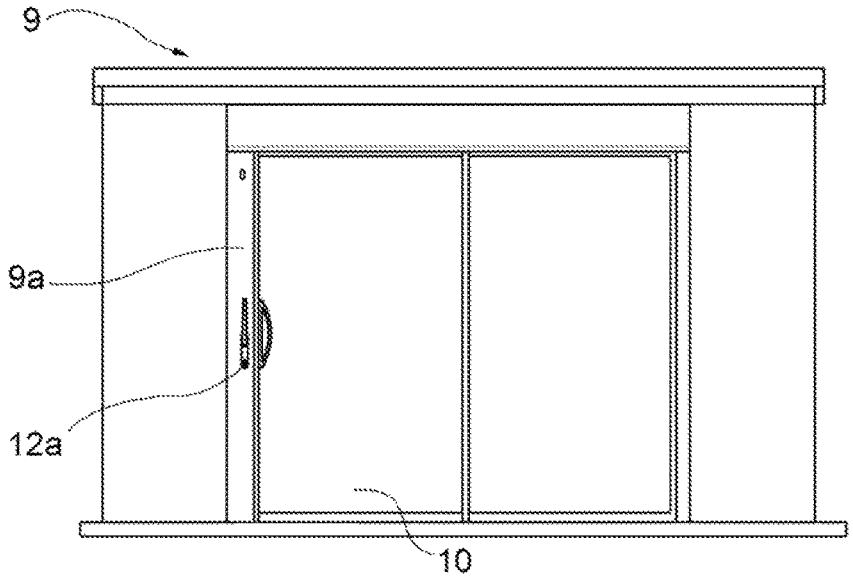
FIGS. 1 to 3 show schematic front views of a door provided with a sliding leaf in three operating conditions, i.e. a closing position, in which a closing/opening handle is located in a first position, a condition where the opening/closing handle is rotationally operated, and a condition where the leaf is free to slide and the handle is located in a second position.
Figure 2:
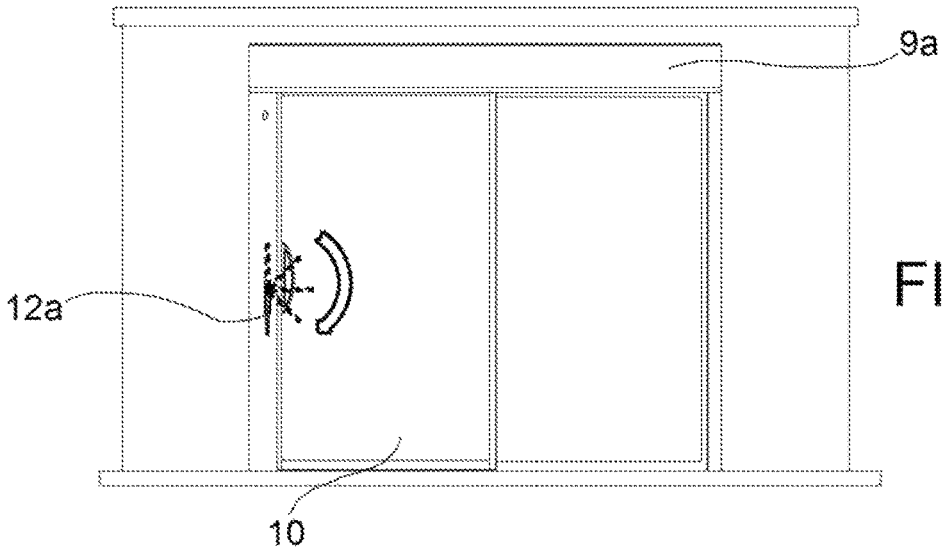
Figure 3:
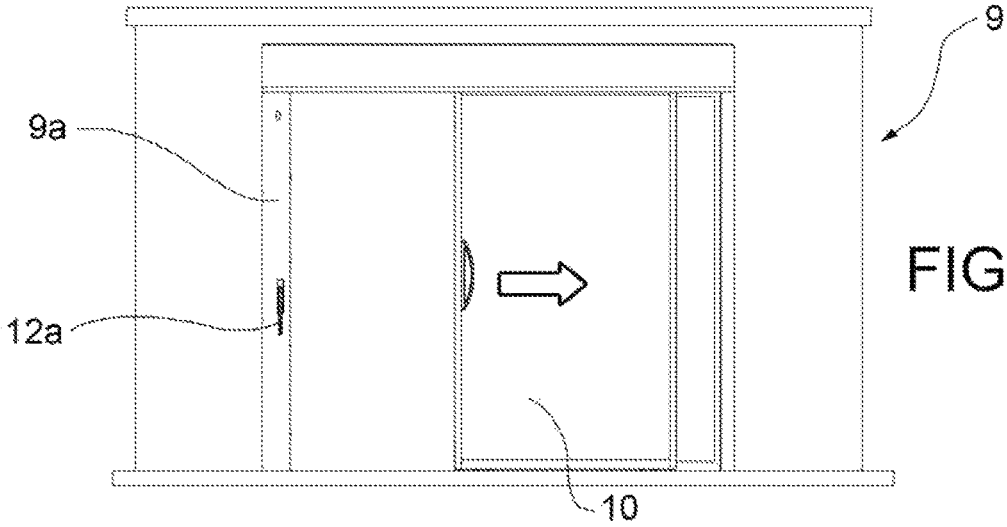

With reference initially to FIGS. 1 to 3, an opening 9 (in the example illustrated, a door or window) comprises a liftable sliding leaf 10 which can be operated between two positions, i.e. open position and closed position. In particular, FIG. 1 shows the closed condition in which the sliding leaf bears against a fixed frame 9*a* of the door or window 9, and the liftable sliding leaf 10 rests on the ground. In this configuration, the leaf is not free to slide. It should be noted, for example, that in this position a handle 12*a* (forming part, in the example illustrated, of an operating mechanism which will be defined more clearly below) is situated in a lifted position.

In FIG. 2, the handle 12*a* is rotated from the lifted position into a lowered position, in which the sliding leaf is lifted and is therefore separated from the ground. In FIG. 3, in-stead, the leaf is finally disengaged and may slide laterally along a guide 14 to which the leaf 10 is connected along a top part 10*a* thereof.

Figure 4:
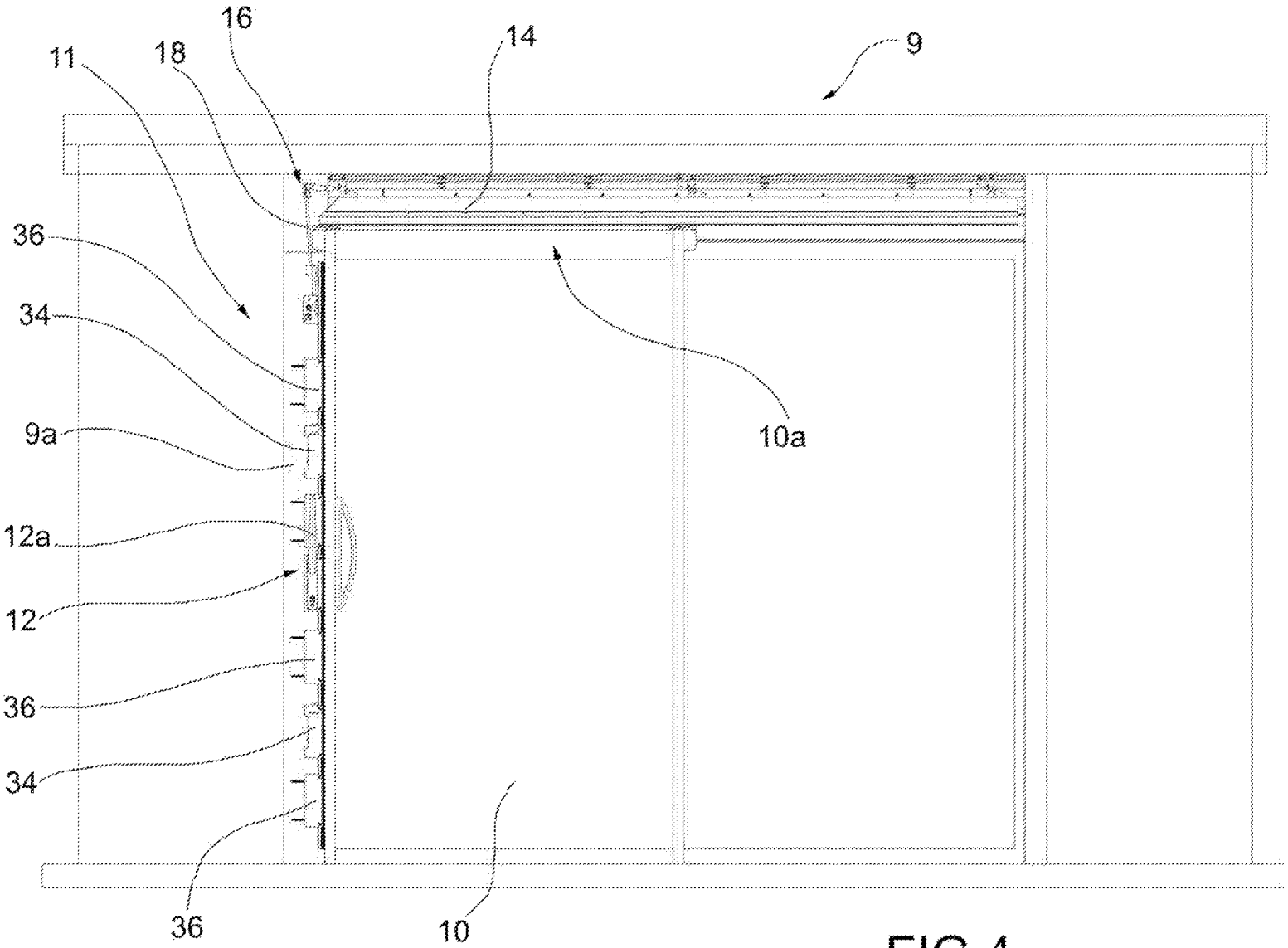
FIG. 4 is a schematic view which shows a lifting and sliding system for a liftable sliding leaf, according to an embodiment of the present invention.

As can be seen in FIG. 4, a lifting system 11 able to release the liftable sliding door 10 is operated by a control member 12 located in the fixed part 9*a* of the door or window 9 (in the example shown, the left-hand part of the fixed frame).

The lifting mechanism 16 is movable between a first configuration and a second configuration—respectively associated with a first condition in which sliding of the liftable sliding leaf 10 is prevented and a second condition in which sliding of the leaf 10 is possible—by lowering and lifting, respectively, the leaf by means of the movement of said lifting mechanism 16. The control member 12 can be connected to and acts on the lifting mechanism 16 so as to switch it between the two configurations.

The lifting mechanism 16 can be connected to the top part 10*a* of the liftable sliding leaf 10 (in the example shown, is connected to the guide 14, which is in turn connected to the top part 10*a* of the leaf).

The lifting mechanism 11 can be conveniently associated with a guide of the type described in IT UB20155123 which is considered incorporated in the present description. In fact, a guide according to the prior art is not suitable for slidably supporting from above a liftable leaf.

According to a preferred embodiment of the invention, the lifting mechanism 16 comprises a linkage system connected to the leaf 10. In the example illustrated, the lifting mechanism 16 comprises a tensioning element or tie-rod 18, which is connected to the control member 12 and to the liftable sliding leaf 10, so as to exert a thrusting and/or pulling force on the top part 10*a* of the leaf 10, causing the lowering or lifting thereof. By activating the control member 12 (for example, by means of rotation of the handle 12*a*) a force is imparted to the tie-rod 18 so as to cause lifting/lowering of the connected sliding leaf 10.

The tie-rod 18 can be connected to the guide 14 which is connected to the top part of the liftable sliding leaf so as to allow horizontal sliding thereof.

In the example illustrated here, the tie-rod 18 may move by means of a slide 20 which is displaced by the control member 12. The slide 20 is connected to the lifting mechanism 16 so as to be movable between the first and second configurations for lifting and lowering the liftable sliding leaf 10. For example, the rotation of the handle 12*a* causes activation of the operating mechanism 12 and, by means of a coupling action of the type known per se, this operating mechanism 12 pushes upwards or downwards the slide 20 which, during the sliding movement, also moves the tie-rod 18.

The tie-rod 18 may then be connected to the liftable sliding leaf 10 by means of a linkage or lever mechanism 22 having a fulcrum 22*a* which is fixed relative to the opening 9 inside which the leaf 10 may be located. The linkage 22 is able to exert a raising or lowering torque on the liftable sliding leaf 10.

In the example illustrated, the linkage 22 comprises a bracket which pivots about the fixed pin 22*a* and the ends of which are connected respectively to the tie-rod 18 and to the guide 14. With this configuration, an articulated connection is formed such that, when the tie-rod 18 is for example pulled downwards, the movement is transmitted to the guide 14 by means of pivoting of the bracket about the pin 22*a*, and the guide moves upwards.

Figure 7:
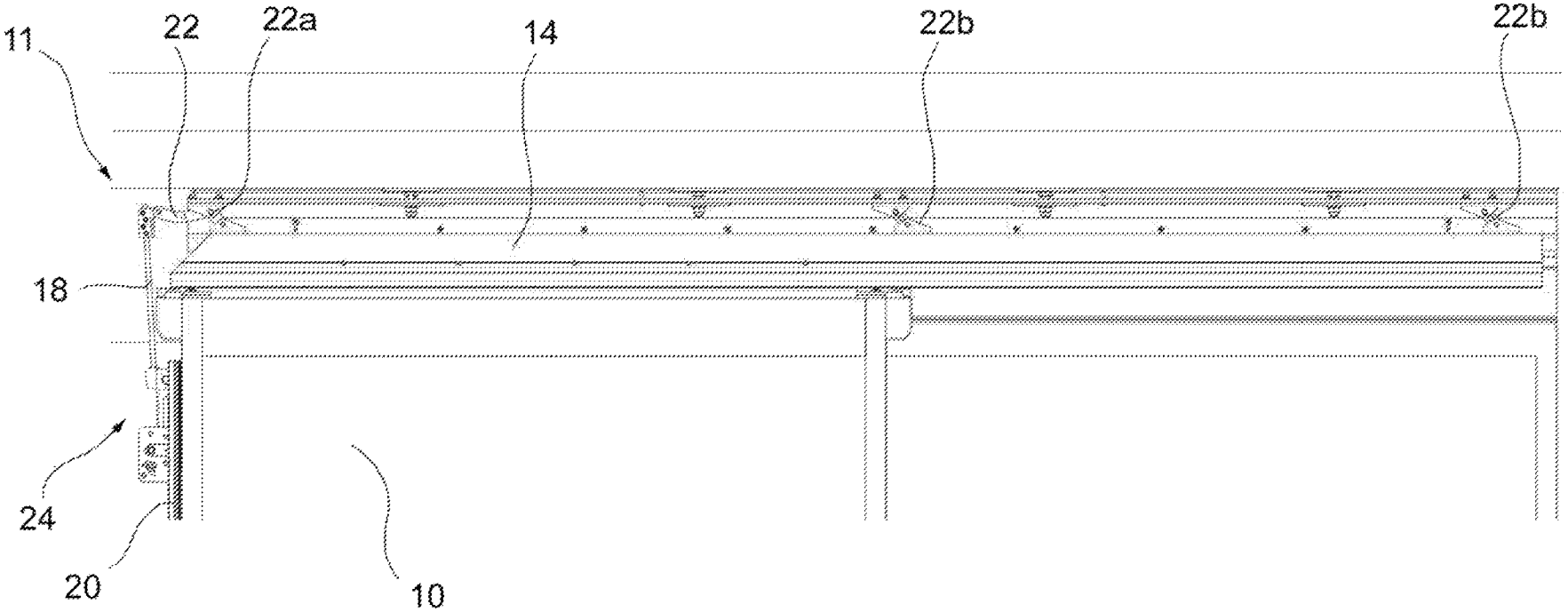
FIG. 7 is a view, on larger scale, of a detail of FIG. 4.
Figure 8:
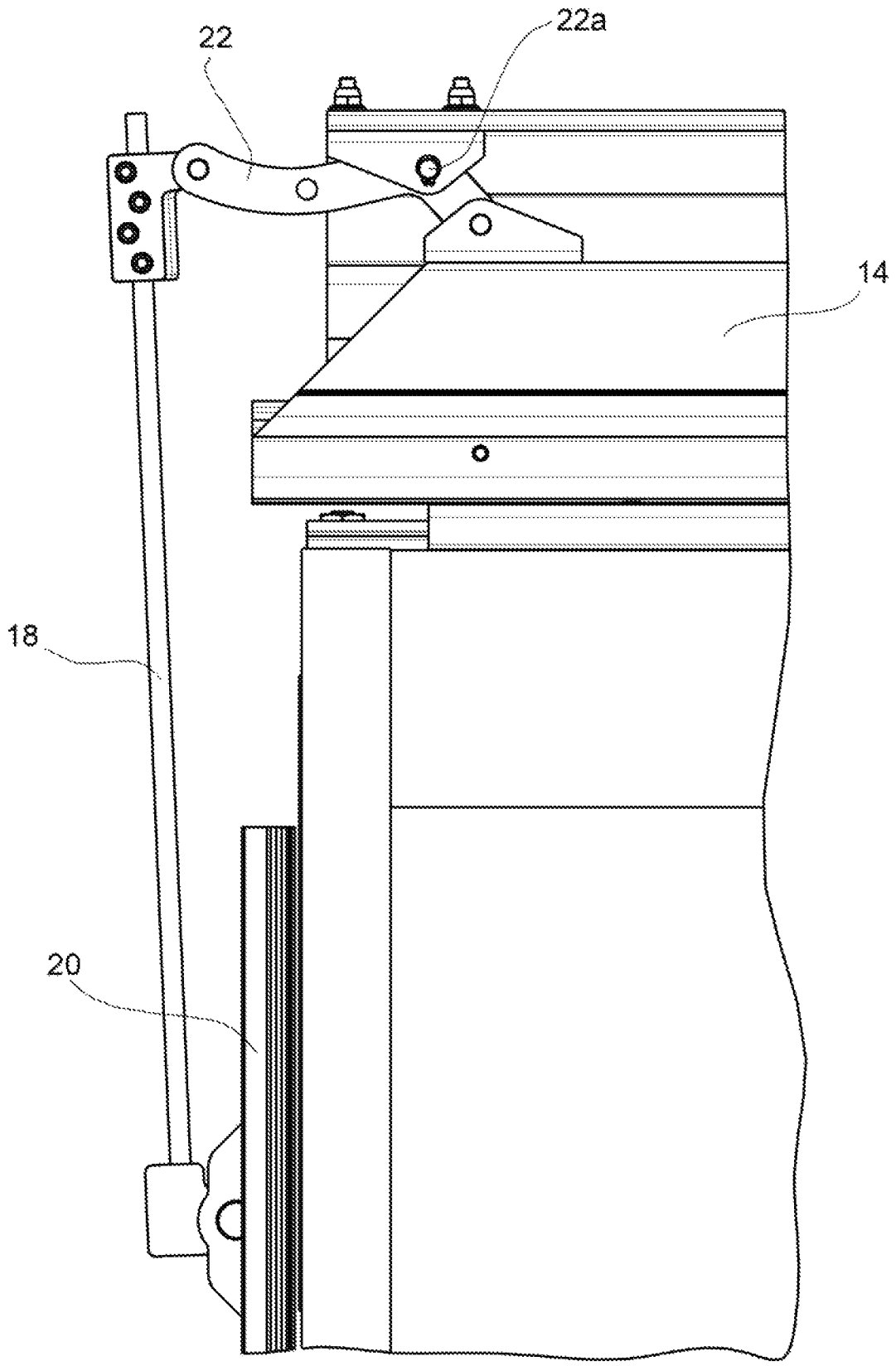
FIG. 8 is a schematic view of a detail of a lifting system, according to an embodiment of the present invention.
Figure 9:
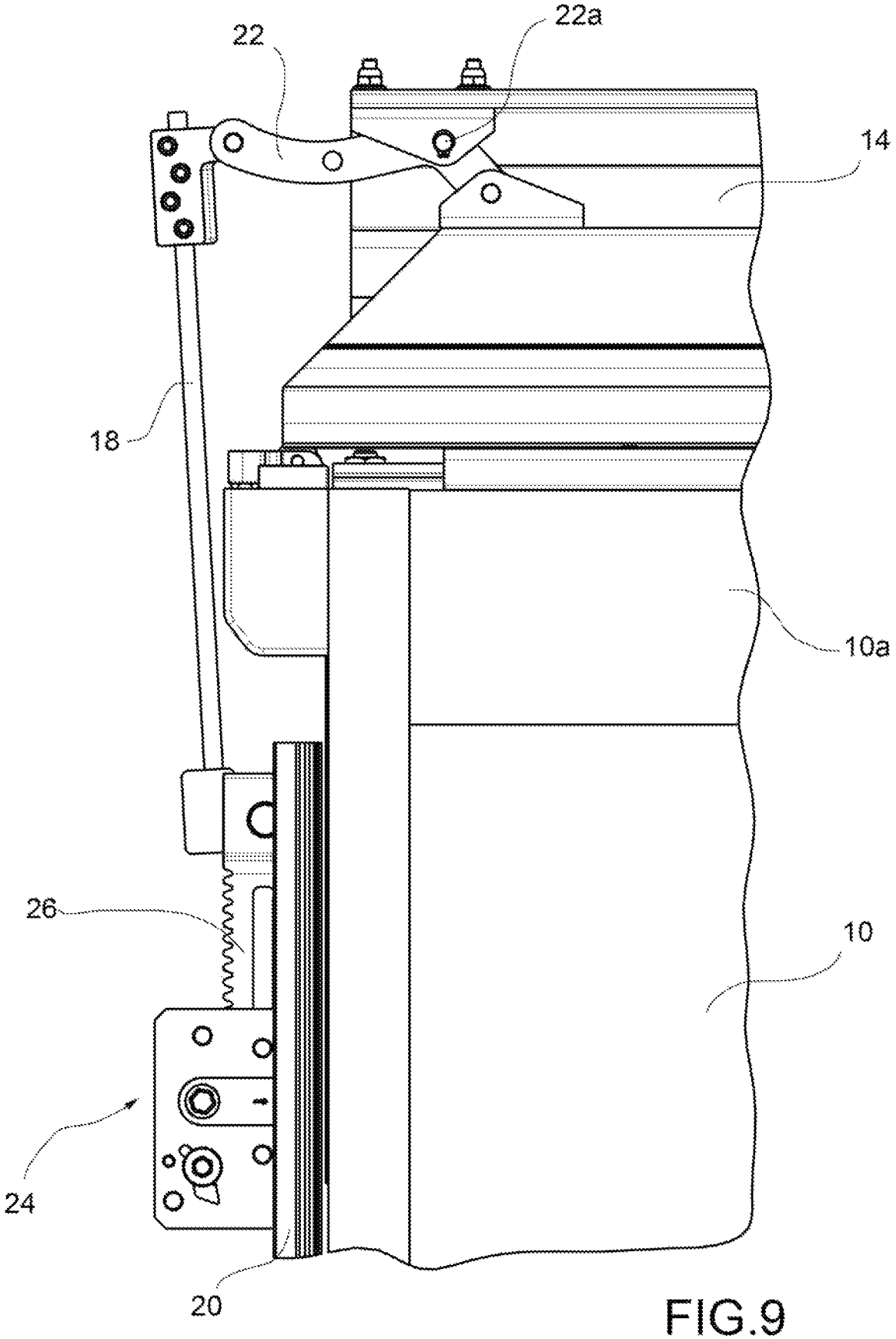
FIG. 9 is a schematic view of an enlarged part of FIG. 7.

In order to allow the guide, which is subject to the lifting force generated by the movement of the tie-rod 18, to move vertically and make contact in a direction parallel to the ground, further secondary linkages 22*b* may be present, these being distributed along the length of the guide (as is visible for example in FIG. 7). In this way, by arranging in series the various linkages 22, 22*b*, a parallelogram mechanism is formed and allows the guide 14 and the leaf 10 to be lifted parallel to the ground.

As an alternative to the configuration described above, other pulling and lifting mechanisms may be used, for example jacks, threaded connections, etc., both of the manual and of the semi-automatic or automatic type.

For example, according to an alternative not shown, the slide 20 may be replaced by a worm screw made to rotate by the operating mechanism 12 and connected to a threaded lead nut which may be displaced vertically. The lead nut may be connected to the guide 14 or to some other element fixed to the leaf 10 so that its displacement moves and/or raises the leaf.

Moreover, the secondary linkages 22*b* may be replaced for example by toothed connections of the ratchet/rack type, where the rack is integral with the fixed support which supports the leaf, and the ratchet is fixed to the latter: in this way, when the guide 14 moves vertically, the ratchet rotates on the rack (or vice versa) until the desired position is reached.

It is possible that the guide 14 may be of the magnetic type or the leaf 10 may be suspended by means of a magnetic interaction between the leaf itself and a fixed support which supports it. In this case, it may be the case that the optimum conditions for operation of the door or window depend on the physical and geometric characteristics of the leaf 10.

In particular, the heavier the leaf, the smaller will be distance at which the magnets fixed respectively to the leaf and the fixed support will be arranged. Therefore, it may not sufficient to lift the leaf by a predetermined amount in order to allow releasing and/or free sliding thereof.

In other words, it is necessary to provide a system which, depending on the type, the volume, the weight, etc. of the leaf 10, allows the lifting movement of the leaf 10 to be set in an optimum manner, depending for example on the angular travel of the handle 12*a*; this, in order to move the leaf closer towards or away from the fixed support by the optimum distance for generating the appropriate force of magnetic interaction.

In the case, for example, of a magnetic guide, or in any other situation where there may be the need for a system for setting the amount by which the leaf 10 must be lifted, it is convenient to arrange an adjustment mechanism 24 between the tie-rod 18 and the slide 20 so that the sliding leaf 10 is lifted by a predetermined amount (for example, the amount which ensures the distance between the magnets needed to develop a sufficient force for lifting and/or keeping the leaf suspended on the guide). Therefore, once the lifting force to be applied to the specific leaf has been estimated, the lifting mechanism may be set during installation of the fixture and optionally adjusted subsequently in order to eliminate play, etc.

Conveniently, the adjustment mechanism 24 comprises two adjustment elements 26, 28 which are movable relative to each other, at least one of the two elements 26 being connected to the tie-rod 18, so as to vary the position of the tie-rod 18 with respect to the slide 20.

Figure 10:
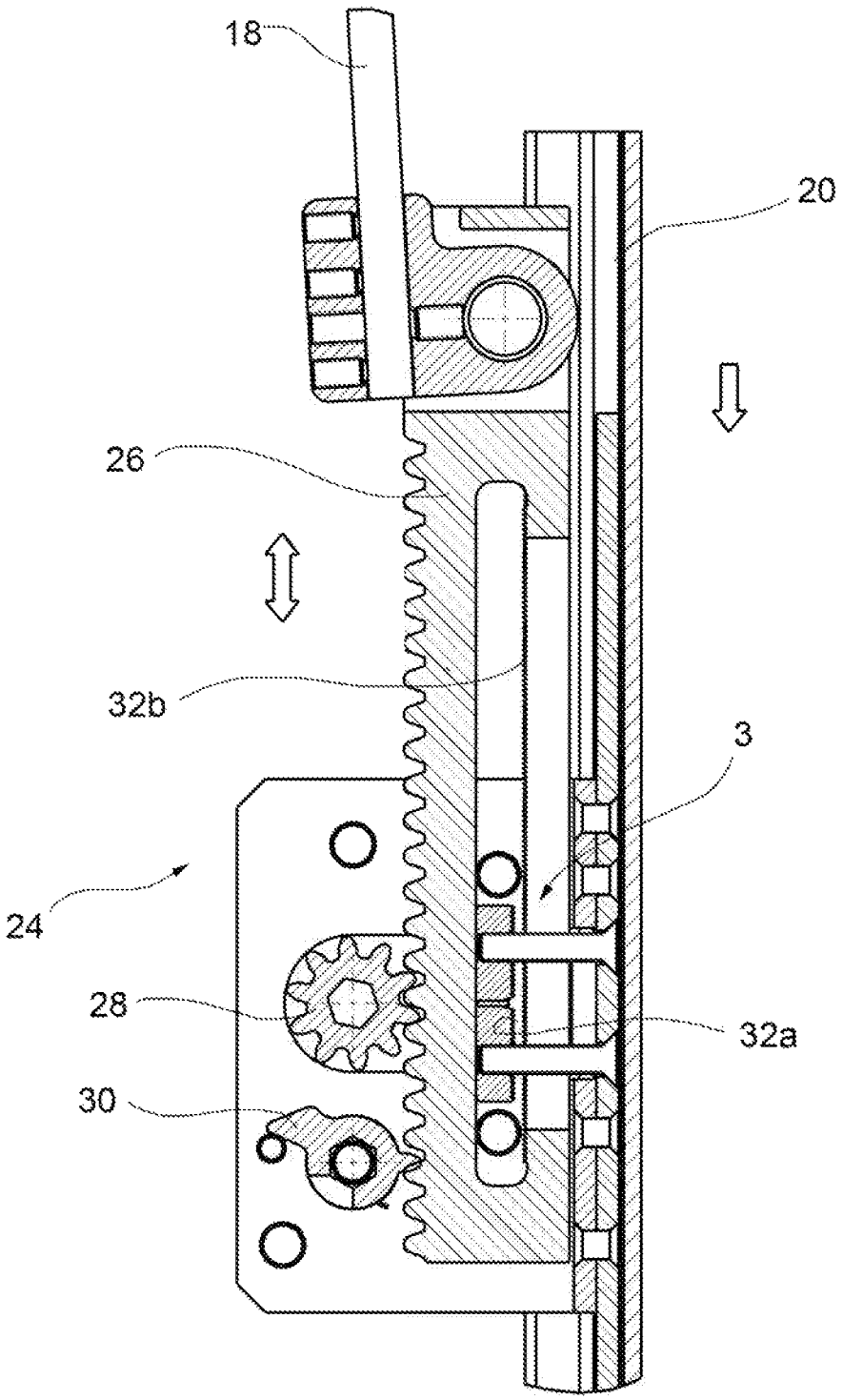
FIG. 10 is a schematic cross-sectional view of a component of a lifting system, according to an embodiment of the present invention.

According to the embodiment shown in FIG. 10, the two movable adjustment elements 26, 28 are connected to a ratchet/rack system, in which the ratchet or pinion or toothed wheel 28 is conveniently movable integrally with the slide 20 and the rack 26 is fixed to the tie-rod 18. Actuation of the ratchet 28 causes the rack 26 to move upwards or downwards, moving also the tie-rod 18. The tie-rod 18 is, in other words, moved closer or further away from the handle 12*a*. In this way, the overall travel of the tie-rod 18 relative to the leaf 10 is modified and consequently, for the same travel movement of the handle 12*a*, a different travel of the tie-rod 18 (and a different lifting movement of the leaf 10) may be obtained in each case.

Conveniently, a pivoting stop 30 may mesh with the toothed profile of the rack 26 so as to allow sliding thereof in one direction, but not in the opposite direction.

Moreover, once the rack 26 has been suitably positioned, it may be rigidly fixed to the slide 20, for example by means of the engagement of two toothed profiles 32*a*, 32*b*, forming part of a locking mechanism 32. More specifically, the toothed profile 32*a* may be moved closer until it meshes with the toothed profile 32*b*, the former being integral with the slide 20 and the latter being formed in the rack 26. However, other possible configurations of the locking mechanism are possible within the scope of the present invention, for example engagement by means of retaining means, screws, welds, etc.

Likewise, the system for engaging together ratchet and rack may be replaced by any other suitable mechanism, such as a female screw mechanism, an endless screw jack, etc.

Figure 5:
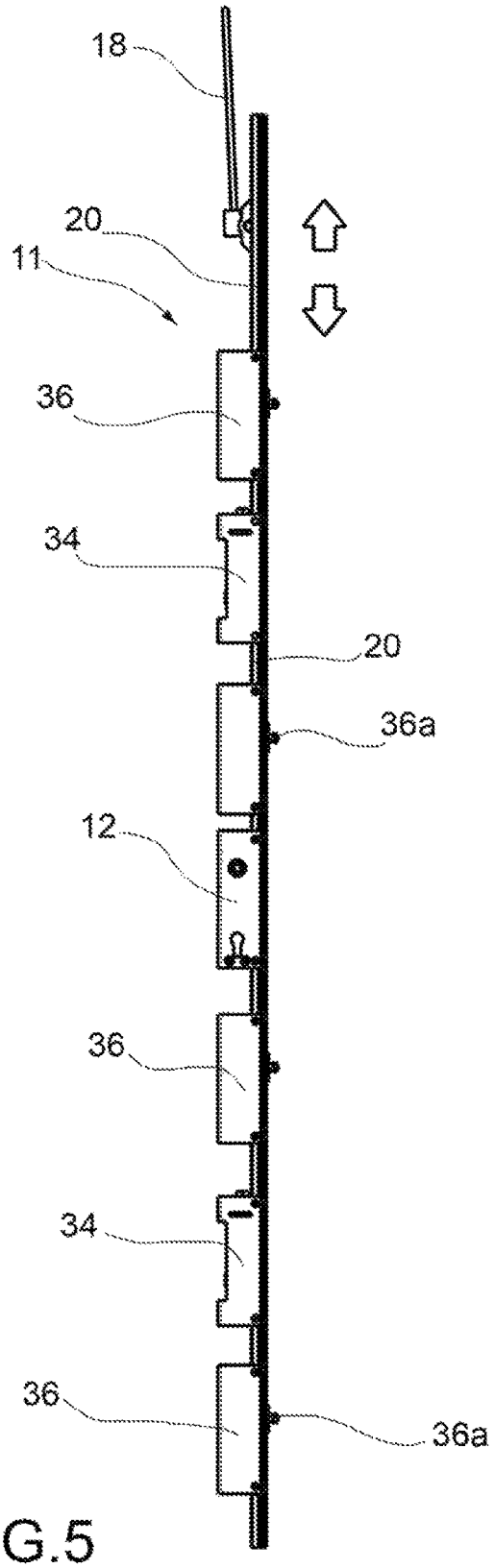
FIGS. 5 and 6 show in schematic form a detail of FIG. 4, in two embodiments of the present invention.
Figure 6:
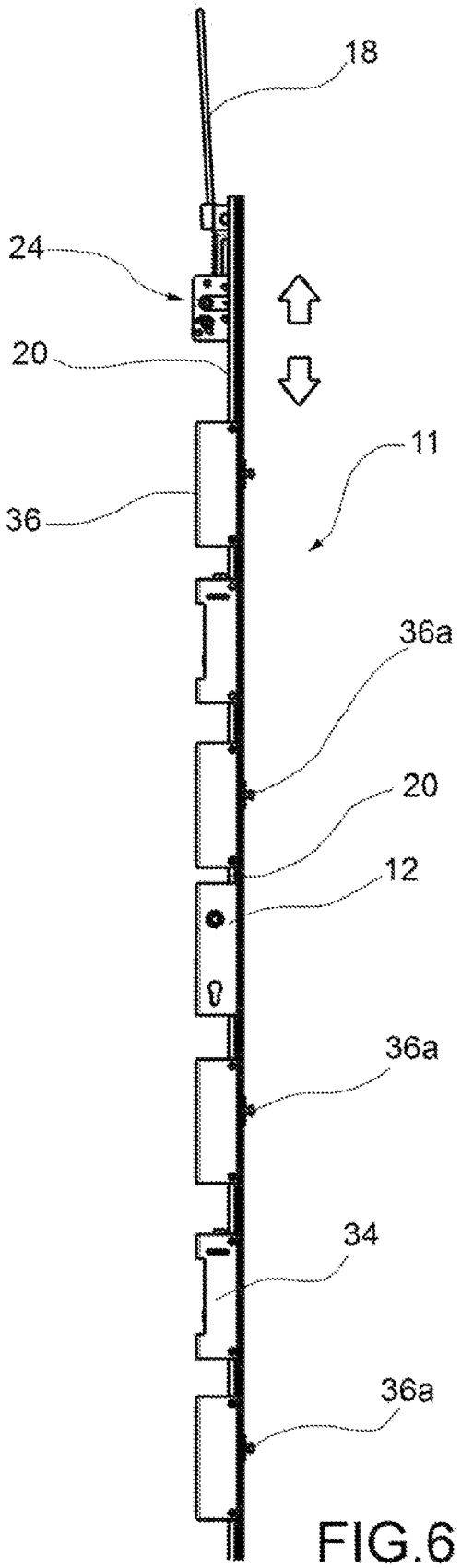

Optionally, the lifting mechanism 11 may comprise one or more devices for compensating the opening and closing forces, which are known per se and visible for example in FIGS. 4, 5 and 6.

Conveniently, the lifting mechanism 11 may be associated with one or more locking devices 36, which are mounted on the fixed frame 9*a* of the door 9. These locking devices 36, which are visible in particular in FIGS. 5, 6 and 11A to 11C, may comprise a projecting element 36*a* having for example the form of a hook or a shaped projection designed to be inserted (in the example shown) inside a through-slot 36*b* formed in the sliding leaf 10.

Figures 11A, 11B, 11C:
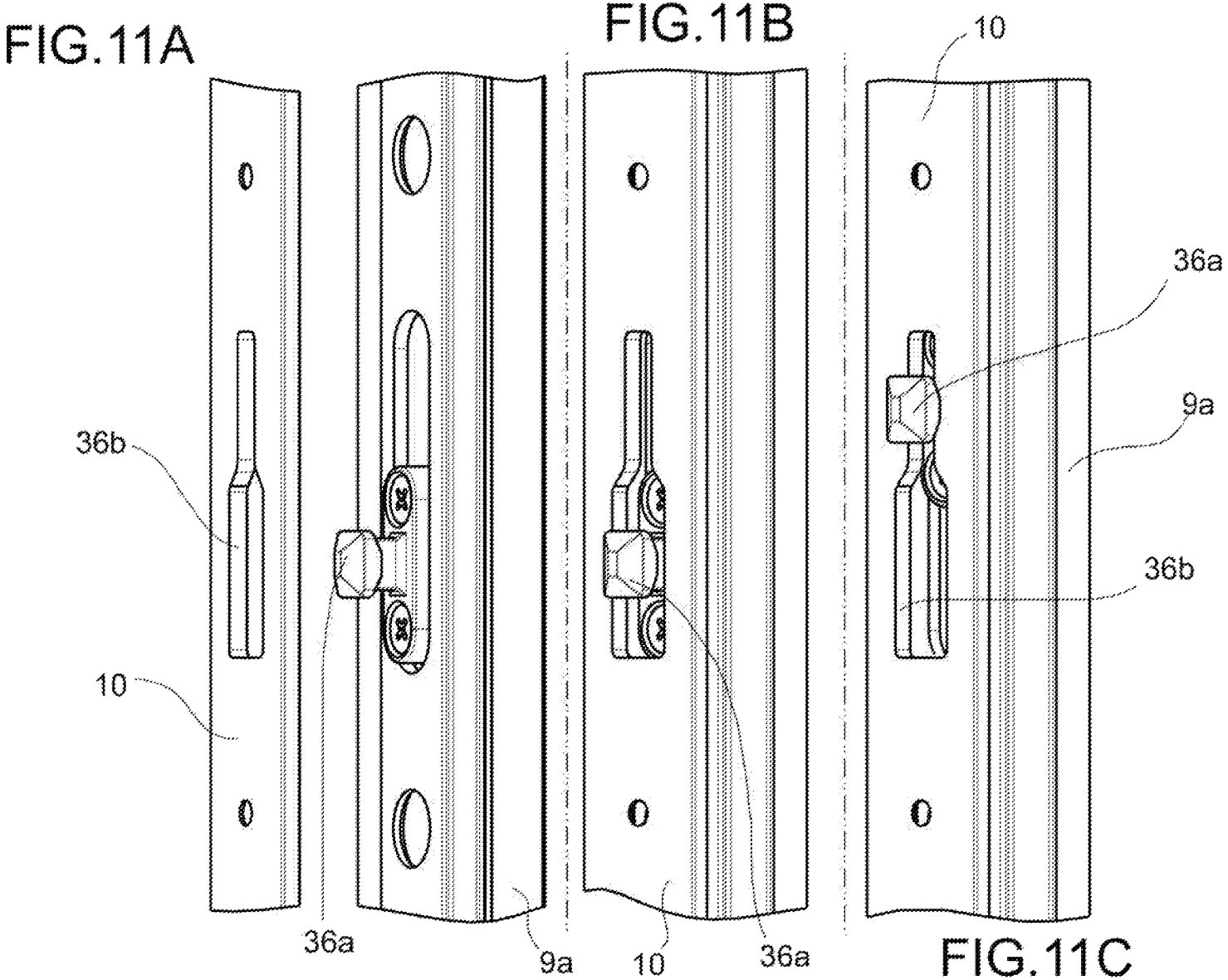
FIGS. 11A to 11C are schematic views of three operating stages where a sliding leaf is engaged by a closing mechanism fixed to the frame of the door or window.

FIGS. 11A to 11C show three stages where the leaf may be fixed and fastened to the frame 9*a* by means of these locking devices 36*a*. In particular, FIG. 11A shows a stage where the leaf 10 is moved towards the fixed frame 9*a* of the door or window 9. When the leaf 10 is free to slide laterally on the guide 14, the projecting element 36*a* and the slot 36*b* are aligned with each other. This allows, as can be seen in FIG. 11B, the projecting element 36*a* to be engaged and to pass through the slot 36*b*. At this point, as can be seen in FIG. 11C, the leaf is lowered and rested on the ground and the projecting element 36*a* is conveniently inserted inside a narrow portion of the slot 36*b*, thus creating a connection which prevents the relative movement of the leaf with respect to the frame. In the example illustrated, locking is possible since the end of the projecting element 36*a* has a cross-section larger than the narrow portion of the slot 36*b*.

However, other locking elements and solutions are also included within the scope of the present invention, for example it is possible to contemplate using a hook which is inserted inside an eyelet, or other solutions which may be considered by the person skilled in the art.

The advantage achieved is that of providing a solution which combines the advantages of a top sliding system for a conventional sliding door and leaf (namely avoiding the raised profiles on the ground or cleaning and/or maintenance of the tracks on the floor), with the possibility of obtaining a liftable leaf which, in the closed position, compresses for example the seals and increases the performance and working life of the fixture.

Different aspects and embodiments of a lifting system for a liftable sliding leaf, a liftable sliding leaf associated with this lifting system, and a door or window comprising this liftable sliding leaf, according to the invention, have been described. It is understood that each embodiment may be combined with any other embodiment. The invention, moreover, is not limited to the embodiments described, but may be varied within the scope defined by the accompanying claims.

The invention claimed is:

1. A lifting system (11) for lifting a liftable sliding leaf (10), in such a way that said liftable sliding leaf (10) is slidable in a horizontal direction, the lifting system comprising:

a lifting mechanism (16), connectable to the liftable sliding leaf (10), said lifting mechanism (16) being movable between a first configuration and a second configuration, respectively associated with a first condition in which sliding of the liftable sliding leaf (10) is prevented and a second condition in which sliding of the liftable sliding leaf (10) is possible, by respectively lowering and lifting said liftable sliding leaf (10) by means of the movement of said lifting mechanism (16);

a control member (12) which can be connected to and acts on the lifting mechanism (16) in such a way as to switch said lifting mechanism (16) between said first and second configurations, said control member (12) being located in a fixed part (9*a*) of an opening (9) comprising the liftable sliding leaf (10);

wherein the lifting mechanism (16) is connectable to a top part (10*a*) of the liftable sliding leaf (10);

wherein the lifting mechanism (16) comprises a tie-rod (18) connected to the control member (12) and connected to the top part (10*a*) of the liftable sliding leaf (10), said tie-rod (18) being able to exert a thrusting or pulling force on said top part (10*a*) so as to cause the lowering or lifting of the liftable sliding leaf (10);

wherein the tie-rod (18) is connectable to the sliding leaf (10) by means of a linkage (22) able to exert a lifting or lowering torque on the liftable sliding leaf (10), pivoting about a fixed pin (22*a*) fixed with respect to the opening (9); and wherein the linkage (22) comprises a bracket pivoting about the fixed pin (22*a*) and having one end connected to the tie-rod (18) and one end connectable to a guide (14), forming an articulated connection so that, when the tie-rod (18) is pulled, the movement can be transmitted to the guide (14) by means of pivoting of the bracket about the pin (22*a*) so as to lift the guide (14).

2. The system according to claim 1, wherein the tie-rod (18) is connectable to the guide (14) connected to the top part of the liftable sliding leaf so as to allow horizontal sliding of said leaf (10).

3. The system according to claim 1, wherein the tie-rod (18) is movable by means of a slide (20), said slide (20) being connected to the lifting mechanism (16) so as to be movable between said first and second configurations for lifting and lowering the liftable sliding leaf (10).

4. The system according to claim 3, wherein an adjustment mechanism (24) is arranged between the tie-rod (18) and the slide (20), in such a way that the liftable sliding leaf (10) is liftable by a predetermined amount, the adjustment mechanism (24) comprising two adjustment elements (26, 28) movable relative to each other, at least one of the two elements (26) being connected to the tie-rod (18) in such a way as to vary the position of the tie-rod (18) relative to the slide (20).

5. The system according to claim 4, wherein the at least one of the two elements (26) connected to the tie-rod (18) is connected to the slide (20) so as to move integrally with said slide (20).

6. A liftable sliding leaf (10) for door or window, associated with a lifting system (11) according to claim 1.

7. A door or window (9), comprising a liftable sliding leaf (10) according to claim 6.

* * * * *